US010951965B2

(12) United States Patent
Ogata et al.

(10) Patent No.: US 10,951,965 B2
(45) Date of Patent: Mar. 16, 2021

(54) BONE CONDUCTION DEVICE

(71) Applicant: DAI-ICHI SEIKO CO., LTD., Kyoto (JP)

(72) Inventors: Kenji Ogata, Ogori (JP); Shogo Kurogi, Ogori (JP); Yoshiyuki Watanabe, Takasaki (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 160 days.

(21) Appl. No.: 16/307,888

(22) PCT Filed: Jun. 13, 2017

(86) PCT No.: PCT/JP2017/021779
§ 371 (c)(1),
(2) Date: Jul. 11, 2019

(87) PCT Pub. No.: WO2017/217399
PCT Pub. Date: Dec. 21, 2017

(65) Prior Publication Data

US 2019/0327543 A1 Oct. 24, 2019

(30) Foreign Application Priority Data

Jun. 14, 2016 (JP) ..... JP2016-117954

(51) Int. Cl.
*H04R 1/02* (2006.01)
*H04R 17/10* (2006.01)

(52) U.S. Cl.
CPC ..... *H04R 1/02* (2013.01); *H04R 17/10* (2013.01); *H04R 2460/13* (2013.01); *H04R 2499/11* (2013.01)

(58) Field of Classification Search
CPC ..... H04R 1/02; H04R 17/10; H04R 2460/13; H04R 2499/11

(Continued)

(56) References Cited

U.S. PATENT DOCUMENTS 4,742,264 A * 5/1988 Ogawa ..... H04R 17/00 310/332
2005/0129257 A1* 6/2005 Tamura ..... H04R 17/00 381/151

(Continued)

FOREIGN PATENT DOCUMENTS

JP 2003-274470 A 9/2003
JP 2003274470 A * 9/2003

(Continued)

OTHER PUBLICATIONS

Notice of Reasons for Refusal (JP Patent Application No. 2018-523924); dated Jul. 16, 2019; 8 pages.

(Continued)

*Primary Examiner* — Fan S Tsang
*Assistant Examiner* — Julie X Dang
(74) *Attorney, Agent, or Firm* — Howard & Howard Attorneys PLLC

(57) ABSTRACT

An oscillator (4) for warping to oscillate due to expansion and contraction of a piezoelectric layer, having a tabular shape and including a substrate and the piezoelectric layer layered on the substrate. A casing (2) has an internal space (2C) accommodating the oscillator (4) and a fixing section (2D) fixing the circumferential edge of the oscillator (4). The casing (2) is conductive of oscillations transmitted from the oscillator (4) via the fixing section (2D) to the outside. A signal input unit (3) receives an audio voltage signal input from a smartphone and applies the signal to the piezoelectric layer. The oscillator (4) has a main surface (4A) having an entire width W1 longer than the entire width of the fixing section (2D) in a direction orthogonal to a direction from the fixing section (2D) to the center of the oscillator (4).

18 Claims, 19 Drawing Sheets

(58) Field of Classification Search
USPC ..... 381/173, 190
See application file for complete search history.

(56) References Cited

U.S. PATENT DOCUMENTS

| | | | | |
|---|---|---|---|---|
| 2007/0041595 | A1* | 2/2007 | Carazo | H04R 17/00 381/151 |
| 2007/0057601 | A1* | 3/2007 | Kawase | H04R 17/00 310/328 |
| 2007/0086608 | A1* | 4/2007 | Hashimoto | H04R 1/46 381/178 |
| 2008/0107290 | A1 | 5/2008 | Tamura | |
| 2009/0046874 | A1* | 2/2009 | Doman | H04R 25/00 381/151 |
| 2011/0064250 | A1* | 3/2011 | Jeong | H04R 17/00 381/186 |
| 2013/0039520 | A1* | 2/2013 | Margolis | H04R 29/001 381/326 |
| 2014/0342783 | A1 | 11/2014 | Suzuki et al. | |
| 2018/0098139 | A1* | 4/2018 | Arevalo Carreno | H04R 17/005 |

FOREIGN PATENT DOCUMENTS

| | | | | | |
|---|---|---|---|---|---|
| JP | 2005-175985 | A | | 6/2005 | |
| JP | 2005175985 | A | * | 6/2005 | H04R 17/00 |
| JP | 2006-237792 | A | | 9/2006 | |
| JP | 2006-238072 | A | | 9/2006 | |
| JP | 2006-238073 | A | | 9/2006 | |
| JP | 2006237792 | A | * | 9/2006 | H04R 17/00 |
| JP | 2006238072 | A | * | 9/2006 | |
| JP | 2007-036530 | A | | 2/2007 | |
| JP | 2007036530 | A | * | 2/2007 | |
| JP | 2014-107828 | A | | 6/2014 | |
| WO | 2013/039033 | A1 | | 3/2013 | |

OTHER PUBLICATIONS

Notice of Reason for Refusal (JP Application No. 2018-523924); dated Oct. 1, 2019; Includes English Translation; 10 pages.

International Search Report and Written Opinion (International Application No. PCT/JP2017/021779); dated Aug. 1, 2017; 9 pages.

* cited by examiner

BONE CONDUCTION DEVICE

CROSS-REFERENCE TO RELATED APPLICATIONS

This application is a national phase application of International Patent Application No. PCT/JP2017/021779, filed Jun. 13, 2017, which claims priority to JP Patent Application No. 2016-117954, filed Jun. 14, 2016, the disclosures of which are hereby incorporated by reference in their entirety.

TECHNICAL FIELD

The present disclosure relates to a bone conduction device.

BACKGROUND ART

Previously developed bone conduction earphones transmit acoustic oscillations to a cranial bone without passing through eardrums and then transmit the oscillations to the inner ears as sound via the cranial bone (for example, refer to Patent Literature 1).

CITATION LIST

Patent Literature

Patent Literature 1: Unexamined Japanese Patent Application Kokai Publication No. 2014-107828.

SUMMARY OF INVENTION

Technical Problem

In Patent Literature 1, the bone conduction earphone itself is required to be inserted into an external auditory canal when listening to sound. This bone conduction earphone has a relatively low electromechanical coupling coefficient, which indicates an efficiency of conversion from electromagnetic energy into mechanical energy, because the oscillator is fixed inside the earphone with a resin. The casing of this bone conduction earphone thus has a relatively small oscillatory displacement. Accordingly, sound is not readily transmitted to the inner ear without insertion of the earphone itself into the external auditory canal.

In consideration of the aforementioned circumstances, an objective of the present disclosure is to provide a bone conduction device that can transmit sound to the inner ear without insertion of the earphone itself into the external auditory canal.

Solution to Problem

To achieve the above-mentioned objective, a bone conduction device according to an embodiment of the present disclosure includes:

an oscillator for warping to oscillate due to expansion and contraction of a piezoelectric layer, having a tabular shape and including a substrate and the piezoelectric layer layered on the substrate;

a casing having an internal space accommodating the oscillator and a fixing section fixing the circumferential edge of the oscillator, the casing being conductive of oscillations to the outside via the fixing section; and a signal input unit for receiving a voltage signal input from an external device and applying the voltage signal to the piezoelectric layer.

The oscillator has a main surface having an entire width longer than an entire width of the fixing section in a direction orthogonal to a direction extending from the fixing section to a center of the oscillator.

The fixing section may fix the circumferential edge of the oscillator at a single site.

In this case, the main surface of the oscillator may have an opening.

The opening of the oscillator may have a rectangular shape having long sides extending in the direction from the fixing section to a center of the oscillator.

The opening of the oscillator may be decentered from a center of the main surface toward an end opposite to the fixing section.

The oscillator may have a cut-out portion that faces the signal input unit.

The oscillator may have a C-shape, a U-shape, or a concave shape.

The fixing section may be disposed at an end opposite to the signal input unit.

The main surface of the oscillator may be symmetrical about a line that extends from a center of the fixing section through the center of the oscillator.

The fixing section may fix the oscillator by sandwiching the oscillator.

The fixing section may have a protrusion protruding in the direction intersecting the main surface of the oscillator, and the oscillator may have a through hole into which the protrusion is inserted.

The oscillator may have a straight cut-out edge having a straight profile and fixed by the fixing section, and the fixing section may have an abutting part to abut the straight cut-out edge.

The oscillator may have a fixed section held and fixed by the fixing section, and scallops are formed on a side wall of the fixed section, the scallops being corrugations repeated in a thickness direction of the fixed section.

The oscillator may further include a weight at a free end of the oscillator.

Scallops may be formed on a side wall of the weight, the scallops being corrugations repeated in a thickness direction of the weight.

A bone conduction device according to another embodiment of the present disclosure includes:

an oscillator for warping to oscillate due to expansion and contraction of a piezoelectric layer, having a tabular shape and including a substrate and the piezoelectric layer layered on the substrate;

a casing having an internal space for accommodating the oscillator, the casing being conductive of oscillations to the outside, the oscillations being transmitted from the oscillator; and a signal input unit for receiving a voltage signal input from an external device and applying the voltage signal to the piezoelectric layer.

The oscillator has a main surface that is entirely fixed to the casing with a double-sided tape.

The bone conduction device may further include a hook for fixing the casing so as to abut the cranial bone of the user when the hook is hung on an ear of the user.

The oscillator may be a plurality of oscillators.

Advantageous Effects of Invention

According to the present disclosure, the width of the oscillator that oscillates in accordance with the voltage signal is larger than the width of the fixing section for fixing the oscillator. This configuration leads to a relatively high electromechanical coupling coefficient, thereby increasing the oscillatory displacement of the casing. Thus oscillations can be transmitted to the cranial bone to vibrate labyrinthine fluid simply due to the casing contacting the skin of the head. The sound can therefore be transmitted to the inner ear without insertion of the earphone itself into the external auditory canal.

DESCRIPTION OF EMBODIMENTS

Embodiments of the present disclosure are described in detail below with reference to the accompanying drawings. In these drawings, identical components are assigned the same reference symbol.

Embodiment 1

Firstly, Embodiment 1 of the present disclosure is described.

Figure 1:
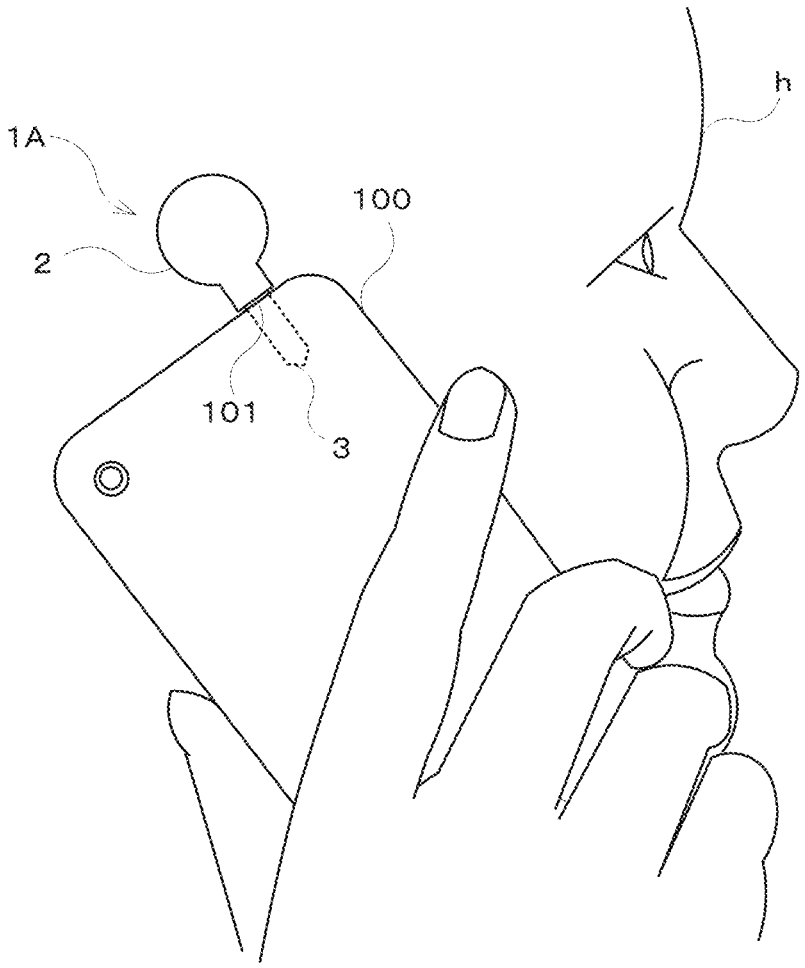
FIG. 1 illustrates a state of a phone call using a smartphone equipped with a bone conduction earphone according to Embodiment 1 of the present disclosure.

With reference to FIG. 1, a bone conduction earphone 1A, which is a bone conduction device according to the present embodiment, includes a casing 2 serving as a housing and a signal input unit 3 protruding from the casing 2. The bone conduction earphone 1A is used after the signal input unit 3 is inserted into an earphone jack 101, which is an audio output electrode of a portable device (for example, a smartphone) 100 that can output sound. The casing 2 is made of a material, such as a resin, that can readily transmit acoustic oscillations and that a human body can safely touch.

During use of the bone conduction earphone 1A, a user h holds the smartphone 100 while keeping the casing 2 of the bone conduction earphone 1A in contact with the skin of the head of the user h. The casing 2 of the bone conduction earphone 1A oscillates in accordance with audio voltage signals output from the earphone jack 101. These oscillations are transmitted as acoustic oscillations via the cranial bone to the inner ear. That is, the bone conduction earphone 1A can be used without insertion into the external auditory canal of the user h. The configurations and operations of the bone conduction earphone 1A, which can be used as described above, are explained below in detail.

Figure 2:
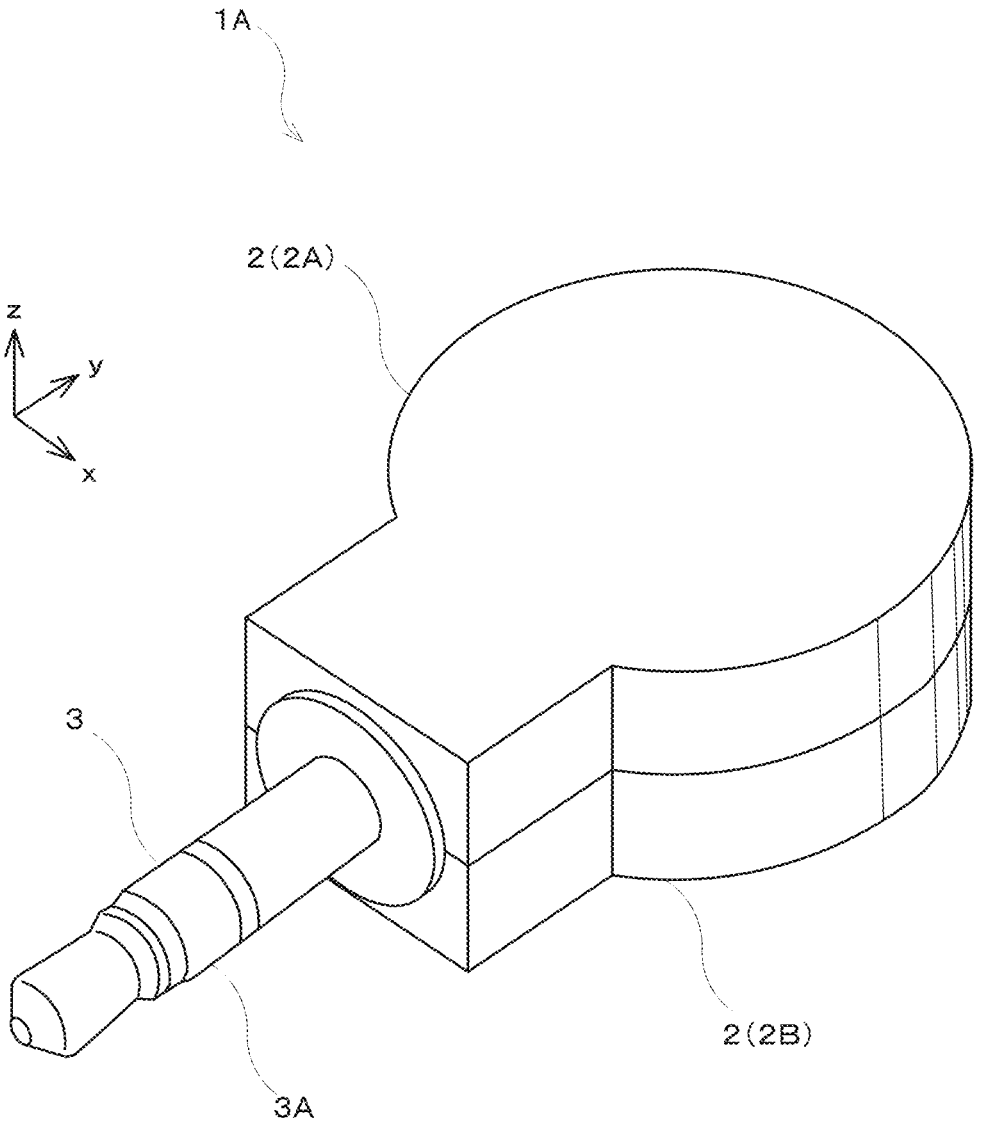
FIG. 2 is a perspective view illustrating the appearance of the bone conduction earphone according to Embodiment 1 of the present disclosure.
Figure 3:
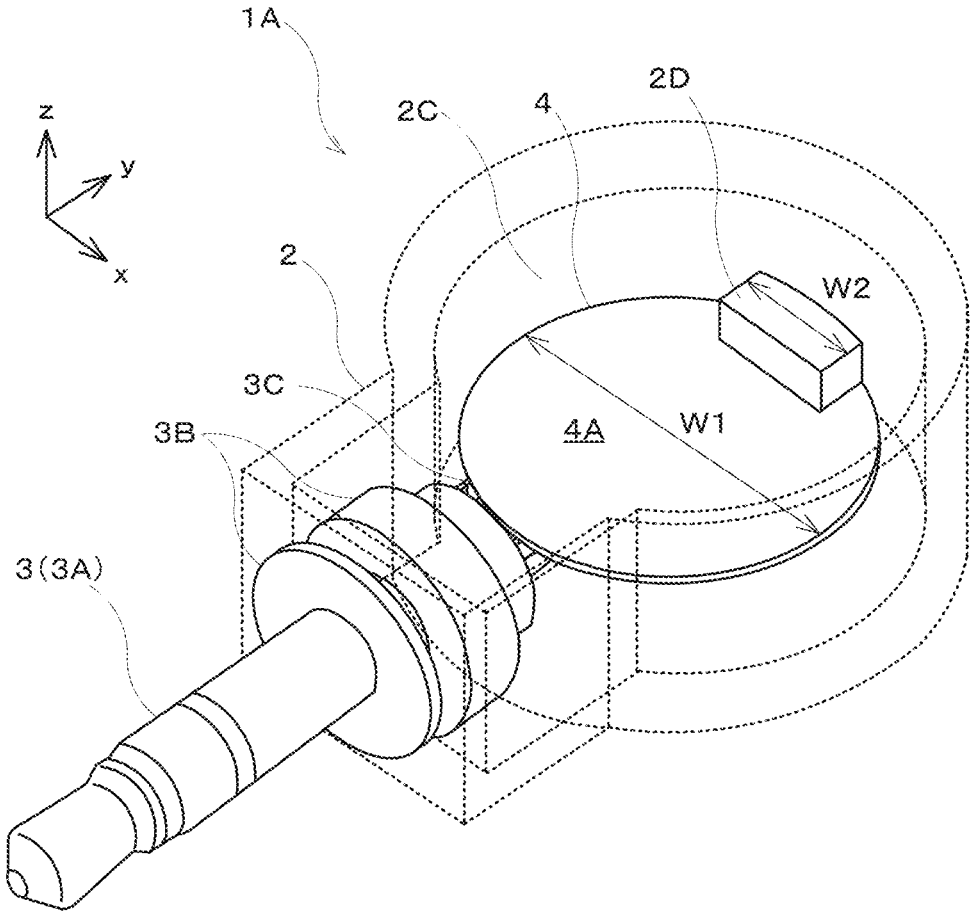
FIG. 3 is a schematic perspective view of the internal configuration of the bone conduction earphone illustrated in FIG. 1.

With reference to FIG. 2, the casing 2 is divided into covers 2A and 2B and is formed by fitting the cover 2A with the cover 2B. The casing 2 has a shape composed of a cylindrical segment and a rectangular parallelepiped segment bonded to a lateral surface of the cylindrical segment. With reference to FIG. 3, the casing 2 has therein an internal space 2C having a shape substantially similar to the external shape. The signal input unit 3 has an engaging section 3B. The engaging section 3B engages the casing 2 while being sandwiched between the lateral walls of the covers 2A and 2B that constitute the end of the rectangular parallelepiped segment. The signal input unit 3 is thus fixed to the casing 2.

The signal input unit 3 has an audio input terminal (earphone plug) 3A protruding from the casing 2. The audio input terminal 3A is inserted into the earphone jack 101 of the smartphone 100 (refer to FIG. 1). The signal input unit 3 further has an output electrode 3C at the end opposite to the audio input terminal 3A in the internal space 2C. The audio input terminal 3A is electrically connected to the output electrode 3C. The audio voltage signal is input from the earphone jack 101 to the audio input terminal 3A, transmitted to the output electrode 3C, and then sent to an oscillator 4.

The bone conduction earphone 1A is equipped with the oscillator 4 that oscillates in accordance with the audio voltage signal output from the output electrode 3C. The oscillator 4 is accommodated in the internal space 2C. The internal space 2C has a sufficient capacity and thus does not come in contact with the oscillating oscillator 4. The signal input unit 3 is also disposed so as not to come into contact with the oscillator 4.

Figure 4A:
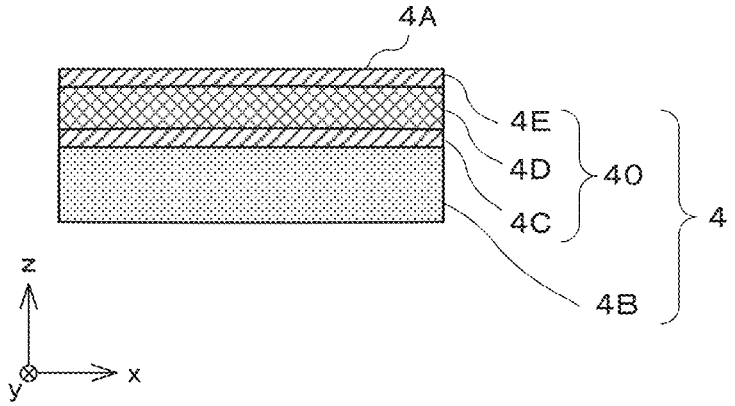
FIG. 4A is a cross-sectional view of a layered structure of an oscillator.

The oscillator 4 is a disk-shaped member that is disposed parallel to the xy plane and has flexibility. The surface of the oscillator 4 that is parallel to the xy plane and that faces the +z side is hereinafter referred to as "main surface 4A". As illustrated in the cross-sectional view of FIG. 4A, the oscillator 4 has a plurality of layers stacked on each other.

Each of the layers of the oscillator 4 is fabricated by micro electro mechanical systems (MEMS) technology, which is semiconductor manufacturing technology. The oscillator 4 is fabricated using a silicon-on-insulator (SOI) substrate. The SOI substrate has a layered structure including a support substrate formed from a semiconductor substrate, a BOX layer that is an embedded oxide film on the support substrate, and a silicon (SOI) layer that is a semiconductor layer on the BOX layer. That is, the SOI substrate is a wafer including an oxide film.

A base material layer 4B, which is the lowermost layer facing the −z side, is formed from a silicon layer on the BOX layer. A lower electrode sublayer 4C, a piezoelectric material sublayer 4D, and an upper electrode sublayer 4E are layered in the order mentioned on the base material layer 4B. The lower electrode sublayer 4C, the piezoelectric material sublayer 4D, and the upper electrode sublayer 4E form a piezoelectric layer 40. That is, the oscillator 4 has the base material layer (substrate) 4B and the piezoelectric layer 40 layered on the base material layer 4B.

The lower electrode sublayer 4C and the upper electrode sublayer 4E are formed from an electrically conductive material (for example, a metal, such as aluminum or copper). The piezoelectric material sublayer 4D is formed from a material (material having piezoelectric properties), such as lead zirconate titanate (PZT). The piezoelectric material sublayer 4D expands and contracts in the longitudinal direction (direction orthogonal to the thickness direction) in response to application of voltage having a certain polarity in the thickness direction.

Figure 4B:
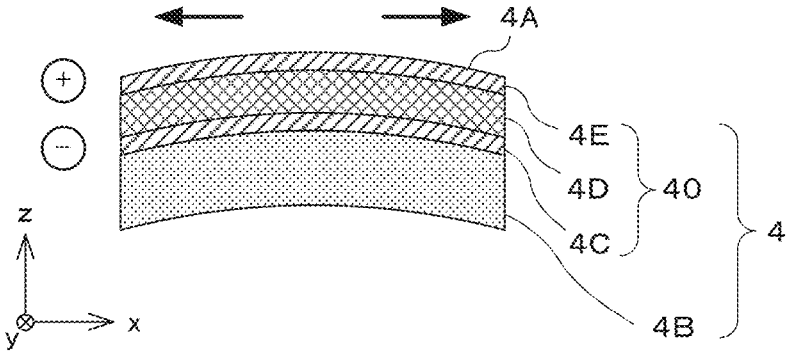
FIG. 4B is a cross-sectional view of the oscillator during application of voltage having a positive polarity to a piezoelectric layer.

With reference to FIG. 4B, upon application of voltage having a polarity (hereinafter referred to as "positive polarity") such that the upper electrode sublayer 4E is positive and the lower electrode sublayer 4C is negative, the piezoelectric layer 40 expands in the longitudinal direction, resulting in a stress in the direction of expansion along the surface (along the y axis) on the main surface 4A. The oscillator 4 thus warps so as to become upwardly convex.

In contrast, with reference to FIG. 4C, upon application of voltage having a polarity (hereinafter referred to as "negative polarity") such that the upper electrode sublayer 4E is negative and the lower electrode sublayer 4C is positive, the piezoelectric layer 40 contracts in the longitudinal direction, resulting in a stress in the direction of contraction along the surface on the main surface 4A. The oscillator 4 thus warps so as to become downwardly convex.

Alternatively, the piezoelectric material sublayer 4D may contract in the longitudinal direction in response to application of voltage between the electrodes such that the upper electrode sublayer 4E is positive and the lower electrode sublayer 4C is negative, and may expand in the longitudinal direction in response to application of voltage between the electrodes such that the upper electrode sublayer 4E is negative and the lower electrode sublayer 4C is positive. In this case, the oscillator 4 warps so as to become downwardly convex in response to application of voltage having the positive polarity and warps to become upwardly convex in response to application of voltage having the negative polarity. That is, the oscillator 4 is only required to warp and oscillate due to expansion and contraction of the piezoelectric layer 40.

Figure 4C:
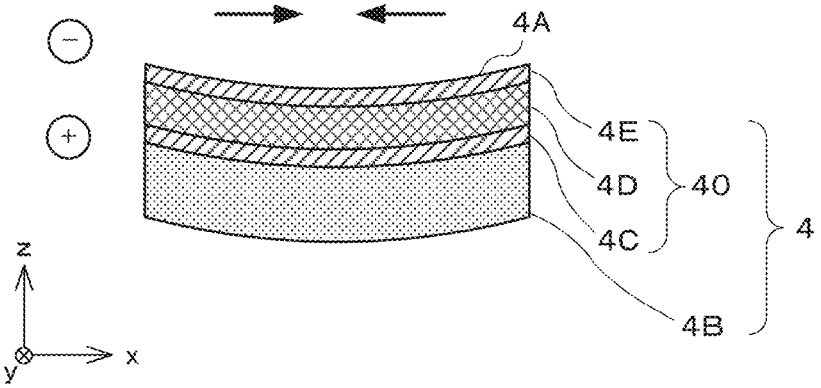
FIG. 4C is a cross-sectional view of the oscillator during application of voltage having a negative polarity to the piezoelectric layer.

In either case, application of voltage having a certain polarity between the upper electrode sublayer 4E and the lower electrode sublayer 4C can cause deformation illustrated in FIG. 4B or 4C. The level of deformation varies depending on the value of the applied voltage. The above-described relationship between the voltage polarity and the expansion or contraction may be reversed because the polarizing action varies depending on the material (for example, a bulk or thin film) of the piezoelectric element.

Figure 5:
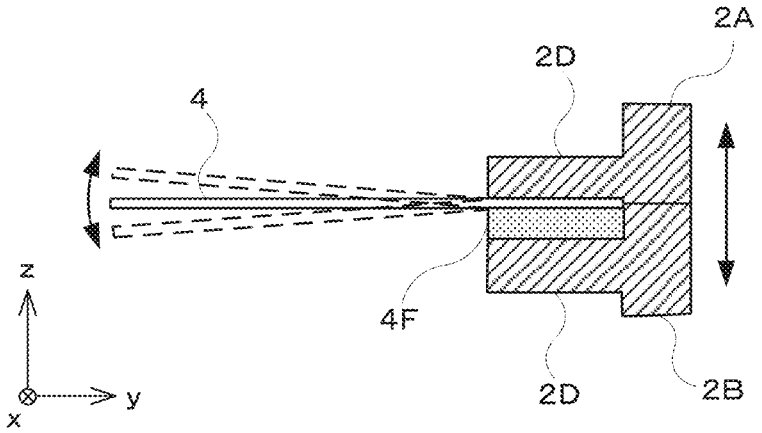
FIG. 5 illustrates a state of transmission of oscillations to a casing.

The casing 2 has fixing sections 2D for fixing the circumferential edge of the oscillator 4 at a single site. With reference to FIG. 5, the oscillator 4 has a fixed section 4F that is fixed by sandwiching between the fixing sections 2D. The fixed section 4F has a thickness larger than the thickness of the other section, that is, the oscillating section that protrudes from the fixed section 4F. The respective fixing sections 2D are provided to the covers 2A and 2B. That is, the pair of fixing sections 2D hold the fixed section 4F therebetween in the z-axis direction to retain the oscillator 4 in a cantilever manner.

Accordingly, if the oscillator 4 repeatedly deforms so as to oscillate, as illustrated in FIGS. 4B and 4C, the free end of the oscillator 4 on the −y side swings up and down about the fixed end formed by the fixing sections 2D (fixed section 4F), as illustrated in FIG. 5.

The output electrode 3C of the signal input unit 3 is connected to the lower electrode sublayer 4C and the upper electrode sublayer 4E via a non-illustrated lead wire. The audio voltage signal output from the earphone jack 101 of the smartphone 100 is applied via the signal input unit 3 to the piezoelectric layer 40 of the oscillator 4. The piezoelectric layer 40 is driven in accordance with the audio voltage signal and thus causes the oscillator 4 to oscillate, as illustrated in FIG. 5. These oscillations are transmitted through the fixed section 4F and the fixing sections 2D to the casing 2 (covers 2A and 2B). The casing 2 can transmit the oscillations, which are transmitted from the oscillator 4 through the fixing sections 2D, to the outside. The user h can thus hear the sound generated by the oscillations.

Figure 6:
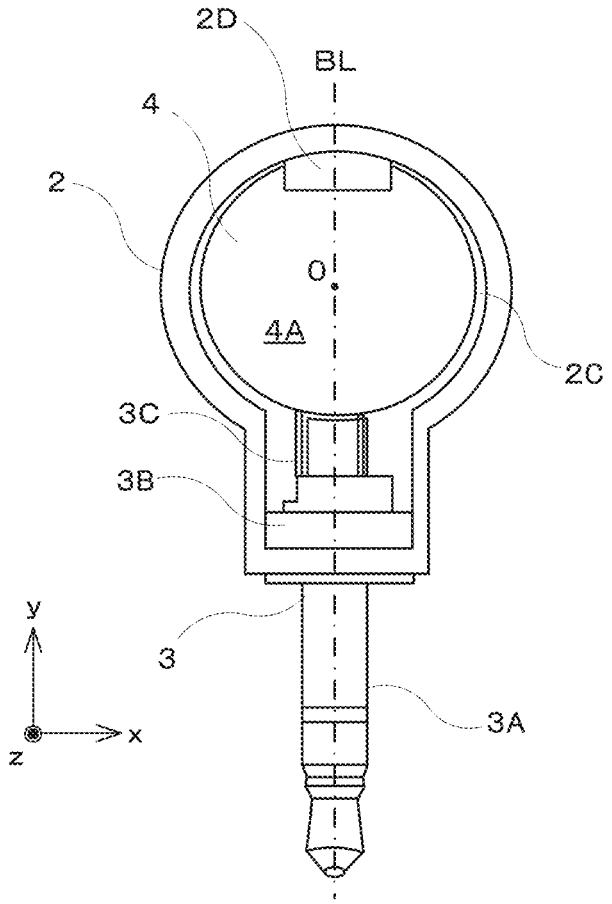
FIG. 6 is an internal top view illustrating the relationship among a fixing section, the oscillator, and a signal input unit.

With reference to FIG. 6, the fixing sections 2D are disposed at the end of the internal space 2C opposite to the signal input unit 3. That is, the fixing sections 2D are disposed as distant as possible from the signal input unit 3 that is inserted into the smartphone 100. The oscillatory displacement of the casing 2 increases with greater distance of the reception positions of the oscillations of the oscillator 4 from the signal input unit 3 that is connected to the smartphone 100 and functions as the base point of the oscillations.

The main surface 4A of the oscillator 4 is symmetrical about a line BL that extends from the fixing sections 2D through the center O of the oscillator 4 and is parallel to the y axis. This shape leads to balanced oscillations of the oscillator 4 retained as a cantilever.

Figure 7:
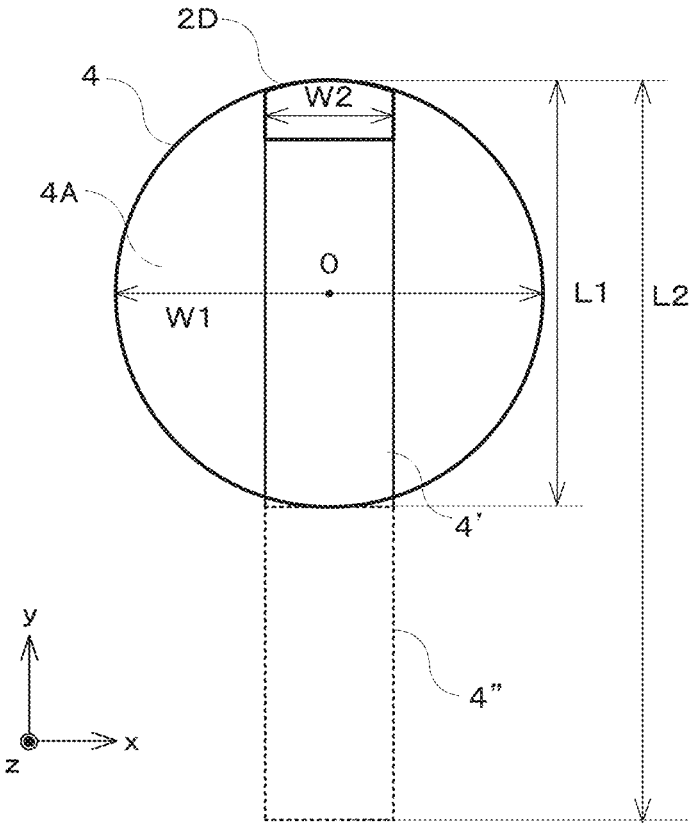
FIG. 7 illustrates a result of comparison between the oscillator illustrated in FIG. 3 and a cantilever oscillator.

With reference to FIG. 7, in the bone conduction earphone 1A according to the present embodiment, the main surface 4A of the oscillator 4 has a width W1 longer than a width W2 of the fixing sections 2D in the direction (x-axis direction) orthogonal to the direction that extends from the fixing sections 2D to the center O of the oscillator 4. This configuration can increase the electromechanical coupling coefficient that is the ratio of the oscillatory displacement (mechanical energy) of the casing 2 to the electromagnetic energy applied to the oscillator 4.

For example, in comparison to a cantilever oscillator 4' that has the same width as the width W2 of the fixing sections 2D and has the same length L1 as the oscillator 4 according to the present embodiment, the oscillator 4 has a higher electromechanical coupling coefficient, resulting in a larger oscillatory displacement of the casing 2. As the oscillatory displacement of the casing 2 increases, the user h can more readily hear the sound.

A cantilever oscillator having the same width as the width W2 of the fixing sections 2D needs to have a length L2 longer than the length L1 (like an oscillator 4" illustrated in FIG. 7), for example, so as to achieve the same electromechanical coupling coefficient as the oscillator 4. In a bone conduction earphone 1A equipped with such a cantilever oscillator, the ratio of the length to the width is excessively high, leading to a poor balance between the length and the width (which may cause difficulty in sound transmission). In contrast, in the bone conduction earphone 1A equipped with the oscillator 4 according to the present embodiment, the displacement of the casing 2 can be increased while ensuring the low ratio of the length to the width (maintaining the balance between the length and the width), thereby achieving easy sound transmission.

When the smartphone 100 equipped with the bone conduction earphone 1A receives an incoming call, the user h inserts the audio input terminal 3A of the bone conduction earphone 1A into the earphone jack 101 and then manipulates the smartphone 100 while keeping the casing 2 in contact with the skin of the head, as illustrated in FIG. 1. This simple operation can start a phone call. The user h can also make a phone call with the smartphone 100 by the same operation. In addition to phone calls, the bone conduction earphone 1A can also be used for listening to music or other recorded audio data.

As described in detail above, the oscillator 4 that oscillates in accordance with audio voltage signals has a width W1 longer than the width W2 of the fixing sections 2D that fix the oscillator 4. This configuration enables a relatively high electromechanical coupling coefficient that is the efficiency of conversion from electromagnetic energy into mechanical energy. The high electromechanical coupling coefficient enables a larger oscillatory displacement of the casing 2, so that the casing 2, just by contacting the skin of the head of the user h, can transmit oscillations to the cranial bone to vibrate labyrinthine fluid. The sound can therefore be transmitted to the inner ear without insertion of the earphone itself into the external auditory canal.

The circular profile of the oscillator 4 in the present embodiment enables a reduction in the size of the bone conduction earphone 1A. For example, the casing 2 of the bone conduction earphone 1A may have a size of approximately 40 mm (length)×20 mm (width)×10 mm (thickness).

The bone conduction earphone 1A according to the present embodiment is not required to be inserted into the external auditory canal. The user h can thus readily hear the environmental sound. This feature enables the user h to avoid dangerous situations and reduces the stress on the user h resulting from inaudibility of the environmental sound.

Although the main surface 4A of the oscillator 4 has a circular profile in the present embodiment, this configuration is not limiting. For example, the main surface 4A may have a polygonal profile, such as a square profile. For example, the main surface 4A may have a trapezoidal or rhombic profile. The ratio of the length in the x-axis direction to the length in the y-axis direction may be freely set.

One of the important parameters of the bone conduction earphone 1A for transmitting high-quality sound to the user h is the resonance frequency of the oscillator 4. The resonance frequency of the oscillator 4 is preferably in the vicinity of 800 Hz or in the range of 400 to 1000 Hz. If the resonance frequency of the oscillator 4 is higher than the preferable range, the thickness of the oscillator 4 may be reduced. Conversely, if the resonance frequency of the oscillator 4 is lower than the preferable range, the thickness of the oscillator 4 may be increased. The above-described cantilever oscillator 4' or 4" tends to have an excessively low resonance frequency. In contrast, the oscillator 4 according to the present embodiment tends to have a resonance frequency within the preferable range.

Embodiment 2

Embodiment 2 is described below.

The main surface 4A of the oscillator 4 has a disk shape in the bone conduction earphone 1A according to the above-described Embodiment 1. The resonance frequency of this configuration tend to be high. In the present embodiment, the configurations and operations for lowering the resonance frequency are mainly described.

Figure 8:
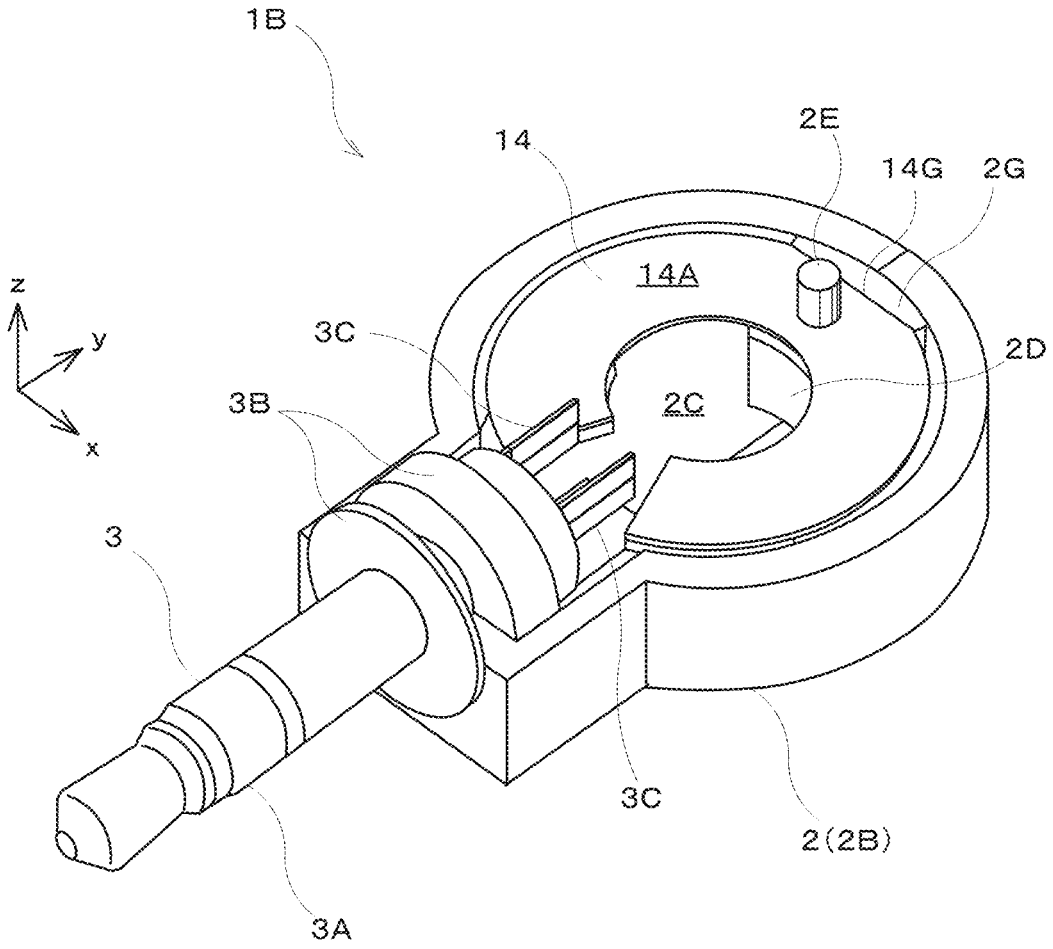
FIG. 8 is a perspective view of the internal configuration of a bone conduction earphone according to Embodiment 2 of the present disclosure.
Figure 9A:
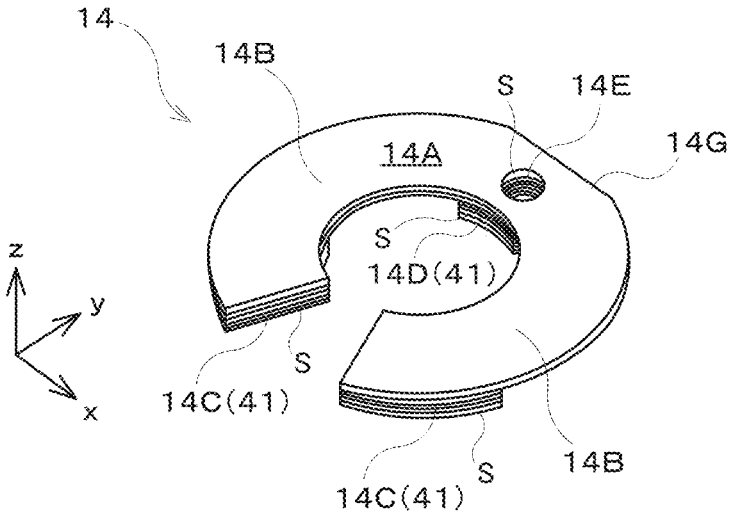
FIG. 9A is a perspective view of an oscillator as viewed from a piezoelectric layer side.
Figure 9B:
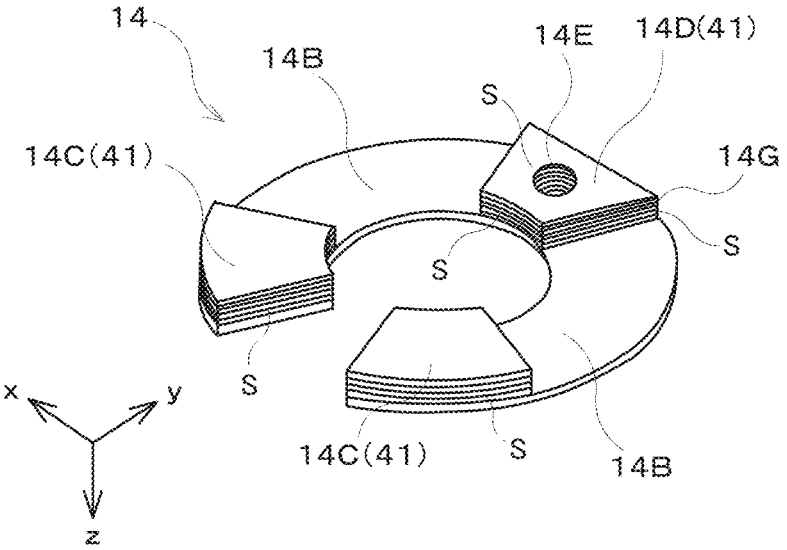
FIG. 9B is a perspective view of the oscillator as viewed from a substrate side.

With reference to FIG. 8, a bone conduction earphone 1B according to the present embodiment includes an oscillator 14, in place of the oscillator 4 according to the above-described Embodiment 1. The surface of the oscillator 14 that is parallel to the xy plane and that faces the +z side is hereinafter referred to as "main surface 14A", as illustrated in FIGS. 9A and 9B. The oscillator 14 differs from the oscillator 4 in that the main surface 14A has a C-shape.

More specifically, the main surface 14A of the oscillator 14 has an opening at the center. This configuration can make the resonance frequency of the oscillator 14 lower than the resonance frequency of the oscillator 4 according to the above-described Embodiment 1.

Furthermore, the portion of the oscillator 14 that faces the signal input unit 3 is cut out. This cut-out portion can accommodate the output electrode 3C of the signal input unit 3, the wiring between the output electrode 3C and the piezoelectric layer 40, and other components. This configuration can further reduce the entire size of the earphone.

In the present embodiment, the procedure of fixing the oscillator 14 to the casing 2 is also different. This fixing procedure is described below.

Figure 10:
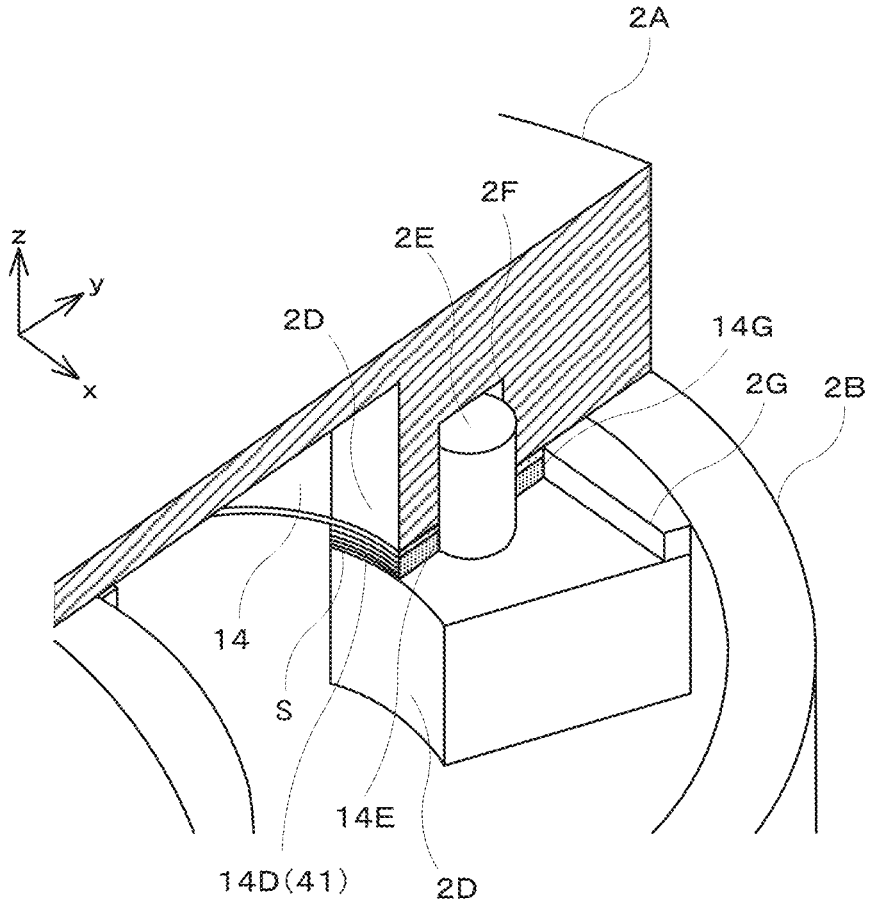
FIG. 10 is a partial cross-sectional view illustrating a fixing section.

With reference to FIG. 10, the covers 2A and 2B of the casing 2 are each provided with a fixing section 2D for fixing the oscillator 14. The oscillator 14 has a fixed section 14D at the +y end, which is fixed between the fixing sections 2D of the casing 2. That is, the fixing section 2D of the cover 2A and the fixing section 2D of the cover 2B hold the fixed section 14D of the oscillator 14 therebetween in the z-axis direction to fix the oscillator 14 in the present embodiment.

The oscillator 14 has arm sections 14B extending from the fixed section 14D toward both sides of the x-axis direction to define an arc shape and reaching the vicinity of the signal input unit 3, as illustrated in FIGS. 8, 9A, and 9B. Each of the arm sections 14B is provided with a weight 14C at the end. The weights 14C are installed to lower the resonance frequency of the oscillator 14.

The oscillator 14 is fabricated by MEMS technology like the oscillator 4 according to the above-described embodiment. The oscillator 14 has a layered structure like the oscillator 4 illustrated in FIG. 4A. That is, the arm sections 14B of the oscillator 14 have the base material layer 4B and the piezoelectric layer 40 layered on the base material layer 4B. The piezoelectric layer 40 expands and contracts in response to application of the audio voltage signal, so that the arm sections 14B warp and oscillate due to the expansion and contraction, as illustrated in FIGS. 4B and 4C.

The fixed section 14D and the weights 14C further have a support substrate layer 41 (refer to FIGS. 9A, 9B, and 10) remaining under the base material layer 4B and the piezoelectric layer 40 that are layered on each other. The fixed section 14D and the weights 14C are formed by deep etching on the silicon layer of the SOI substrate. The side walls of the fixed section 14D and the weights 14C are provided with scallops S corrugations repeated in the thickness direction. The scallops S are corrugations in the depth (thickness) direction that are formed by repeated etching steps in the deep etching. The number of scallops S depends on the number of the below-described repeated etching steps. The deep etching is also called the Bosch process. The Bosch process is performed by repetition of steps of isotropic etching, protective film formation (passivation), and anisotropic etching.

Figure 12:
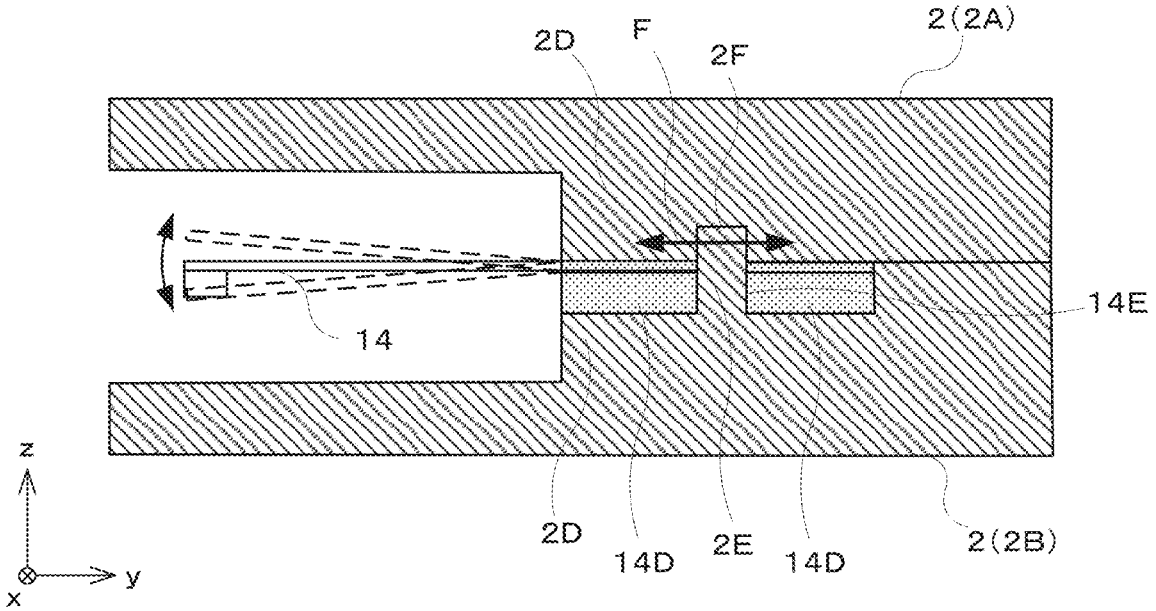
FIG. 12 illustrates the state of oscillations of the casing.

The fixed section 14D further has a through hole 14E extending through the fixed section 14D in the z-axis direction. The fixing section 2D of the cover 2B has an upright boss 2E that is a cylindrical protrusion. The boss 2E is inserted into the through hole 14E of the oscillator 14. The fixing section 2D of the cover 2A has a cylindrical recess 2F. The top of the boss 2E is inserted through the through hole 14E into the recess 2F. The boss 2E disposed in the through hole 14E can restrict horizontal movement F of the oscillator 14 within the casing 2, as illustrated in FIG. 12. That is, the fixing section 2D has the boss 2E protruding in the direction intersecting the main surface 14A of the oscillator 14, while the oscillator 14 has the through hole 14E into which the boss 2E is inserted in the present embodiment. This configuration can more firmly fix the oscillator 14 at a desired position of the casing 2.

Figure 13:
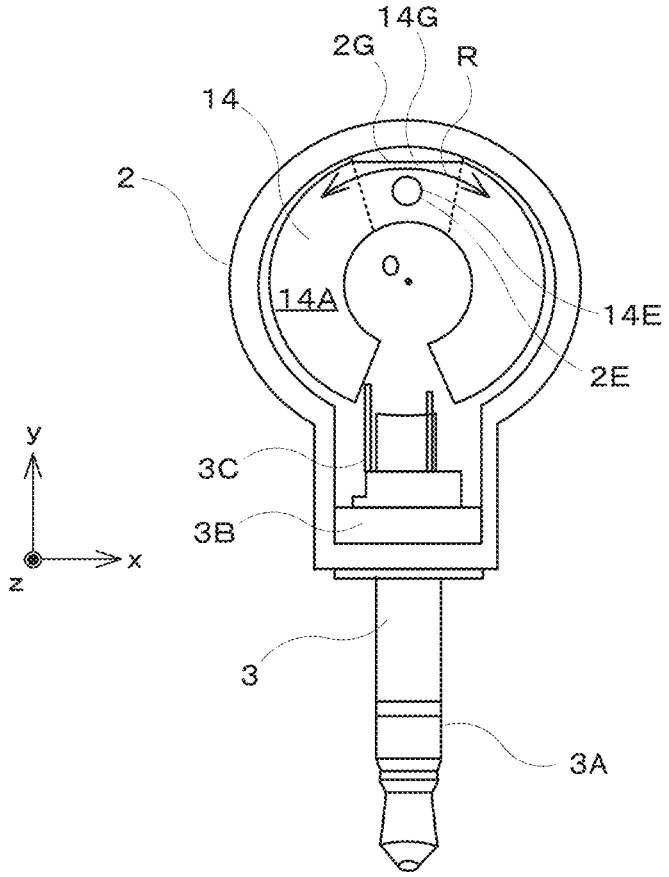
FIG. 13 illustrates operation of a side wall.

The fixed section 14D is provided with a straight cut-out edge 14G at the +y end, as illustrated in FIG. 10. The cover 2B has a straight side wall 2G extending in the x-axis direction. The side wall 2G abuts the cut-out edge 14G of the oscillator 14. This configuration can restrict rotation R of the oscillator 14 around the boss 2E in the xy plane within the casing 2, as illustrated in FIG. 13.

Figure 11:
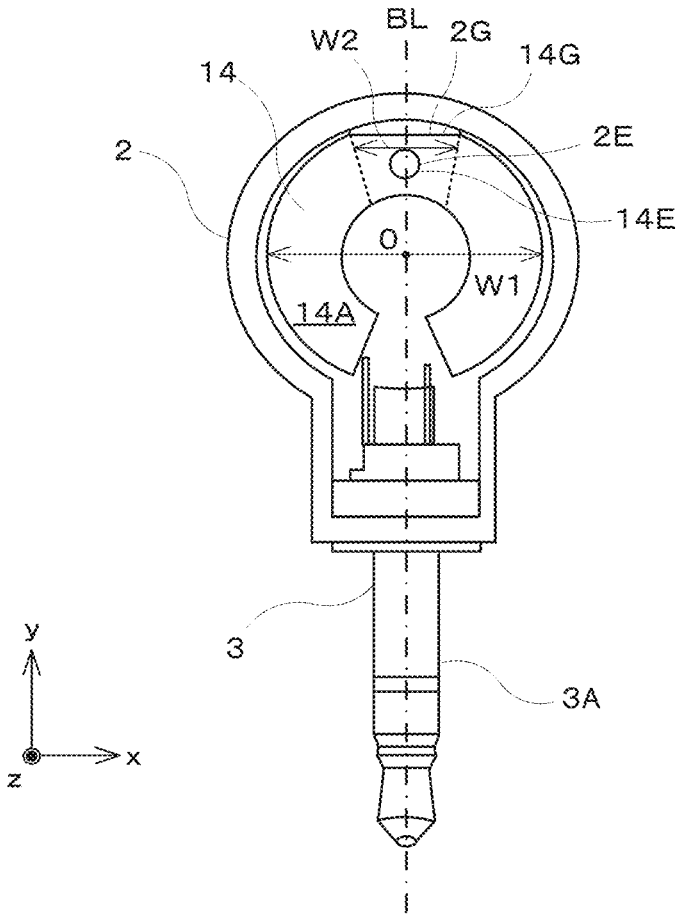
FIG. 11 is an internal top view illustrating the relationship among the fixing section, the oscillator, and a signal input unit.

The oscillator 14 has the same entire size (radius and thickness) as that of the oscillator 4. As illustrated in FIG. 11, the main surface 14A of the oscillator 14 has an entire width W1 longer than an entire width W2 of the fixing sections 2D in the direction orthogonal to the direction that extends from the boss 2E (fixing sections 2D) to the center O of the oscillator 14, like the oscillator 4. This configuration can increase the electromechanical coupling coefficient of the oscillator 14 to increase the oscillatory displacement of the casing 2, thereby enabling easy sound transmission, as in the bone conduction earphone 1A according to the above-described Embodiment 1.

The main surface 14A of the oscillator 14 is symmetrical about the line BL that extends from the boss 2E (fixing sections 2D) through the center O of the oscillator 14 and that is parallel to the y axis. This shape enables balanced oscillations of the oscillator 14 retained as a cantilever.

Figure 14A:
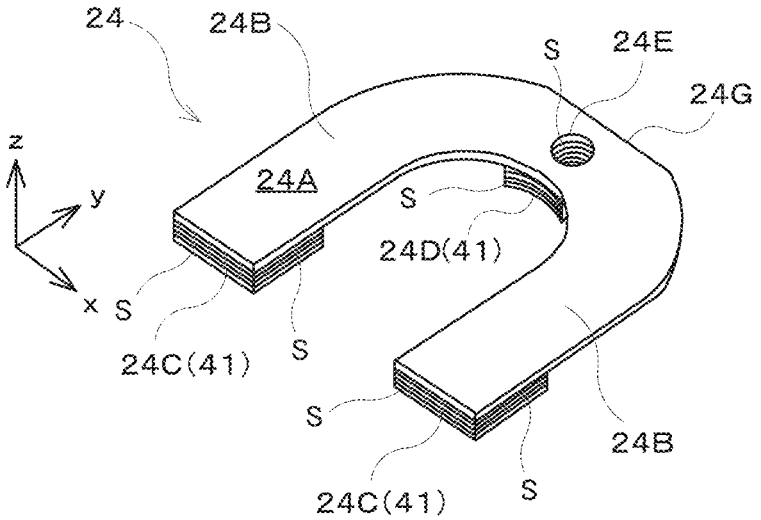
FIG. 14A illustrates an oscillator according to a first modification (upper surface)
Figure 14B:
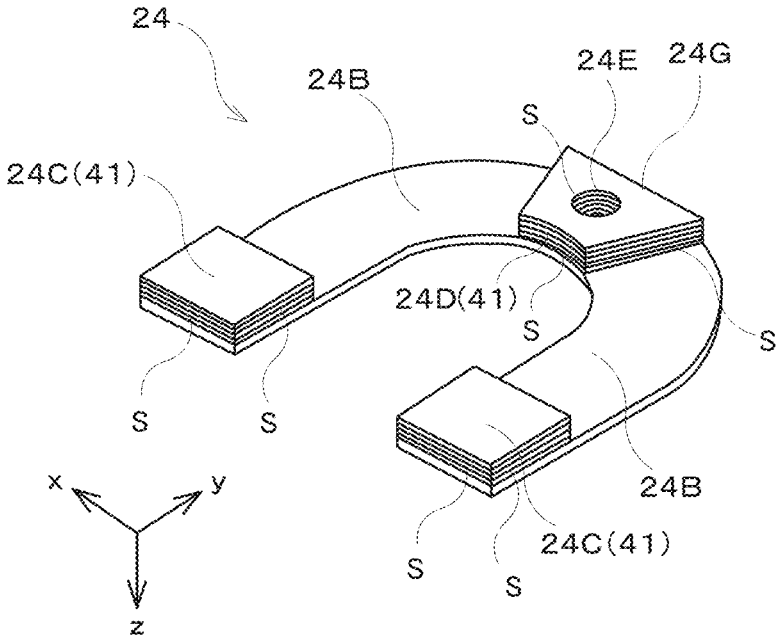
FIG. 14B illustrates the oscillator according to the first modification (lower surface)

Although the oscillator 14 according to the present embodiment that has a C-shape, the oscillator 14 may be replaced with an oscillator 24 illustrated in FIGS. 14A and 14B. The oscillator 24 has a main surface 24A having a U-shape. Specifically, the oscillator 24 also has a fixed section 24D to be fixed between the fixing sections 2D. The fixed section 24D is provided with a through hole 24E, and a straight cut-out edge 24G like the cut-out edge 14G. The through hole 24E receives the boss 2E of the fixing section 2D of the casing 2 inserted therethrough, while the cut-out edge 24G abuts the side wall 2G of the fixing section 2D of the casing 2. This configuration can fix the oscillator 24 at a desired position within the casing 2 and achieve firm fixation between the fixing sections 2D of the casing 2 and the fixed section 24D of the oscillator 24.

A pair of arm sections 24B extend from the fixed section 24D. Each of the arm sections 24B is composed of an arc subsection adjoining the fixed section 24D and a straight subsection extending in the −y direction. Each of the arm sections 24B is provided with a weight 24C at the end. The weights 24C are installed to adjust the resonance frequency of the oscillator 24. The arm sections 24B oscillate in response to application of the audio voltage signal. These oscillations are transmitted through the fixed section 24D and the fixing sections 2D to the casing 2.

The oscillator 14 does not necessarily have a C-shaped or U-shaped main surface. The main surface is only required to have an opening at the center and have a concave shape defined by a cut-out portion that faces the signal input unit 3.

Figure 15A:
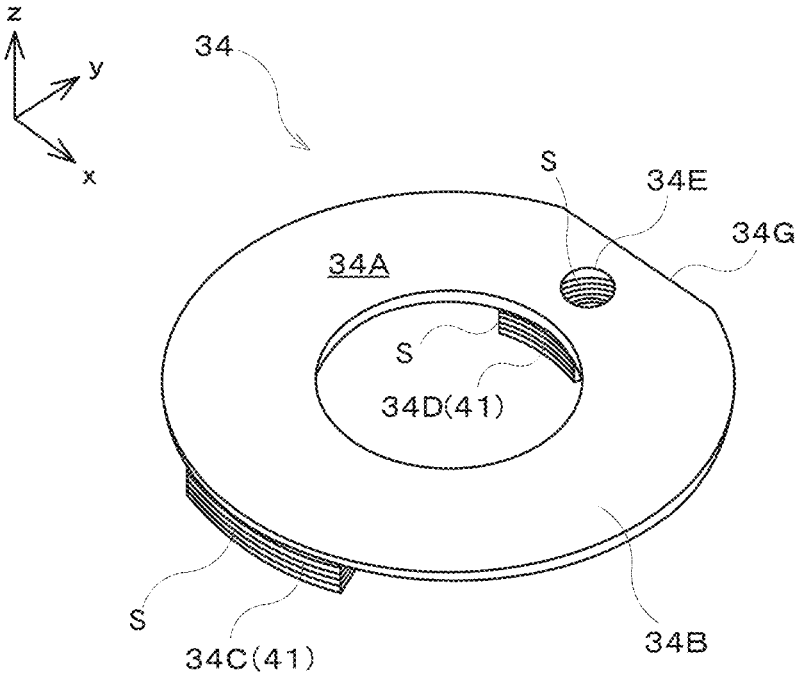
FIG. 15A illustrates an oscillator according to a second modification (upper surface)
Figure 15B:
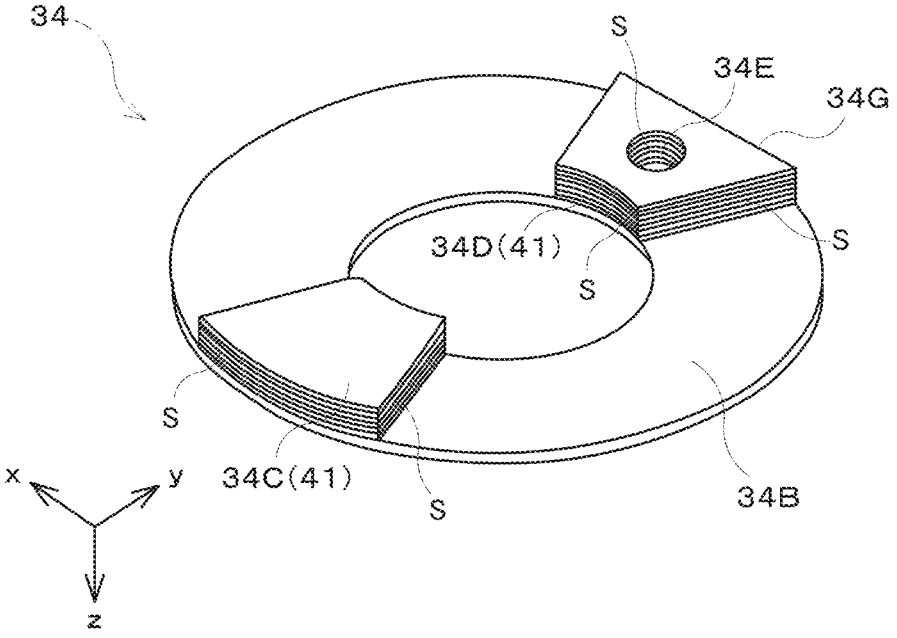
FIG. 15B illustrates the oscillator according to the second modification (lower surface)

Alternatively, the oscillator 14 may be replaced with an oscillator 34 illustrated in FIGS. 15A and 15B. The oscillator 34 has a main surface 34A having an annular shape. Specifically, the oscillator 34 also has a fixed section 34D to be fixed between the fixing sections 2D. The fixed section 34D is provided with a through hole 34E and a straight cut-out edge 34G. The through hole 34E receives the boss 2E of the fixing section 2D of the casing 2 inserted therethrough, and the cut-out edge 34G abuts the side wall 2G of the fixing section 2D of the casing 2. This configuration can fix the oscillator 34 at a desired position of the casing 2 and achieve firm fixation between the fixing sections 2D of the casing 2 and the fixed section 34D of the oscillator 34.

An oscillating section 34B extends from the fixed section 34D, defines an arc shape, and returns to the fixed section 34D, that is, has a substantially annular shape. The oscillating section 34B is provided with a weight 34C at the −y end. The weights 34C are installed to adjust the resonance frequency of the oscillator 34. The oscillating section 34B oscillates in response to application of the audio voltage signal. These oscillations are transmitted through the fixed section 34D and the fixing sections 2D to the casing 2.

Figure 16A:
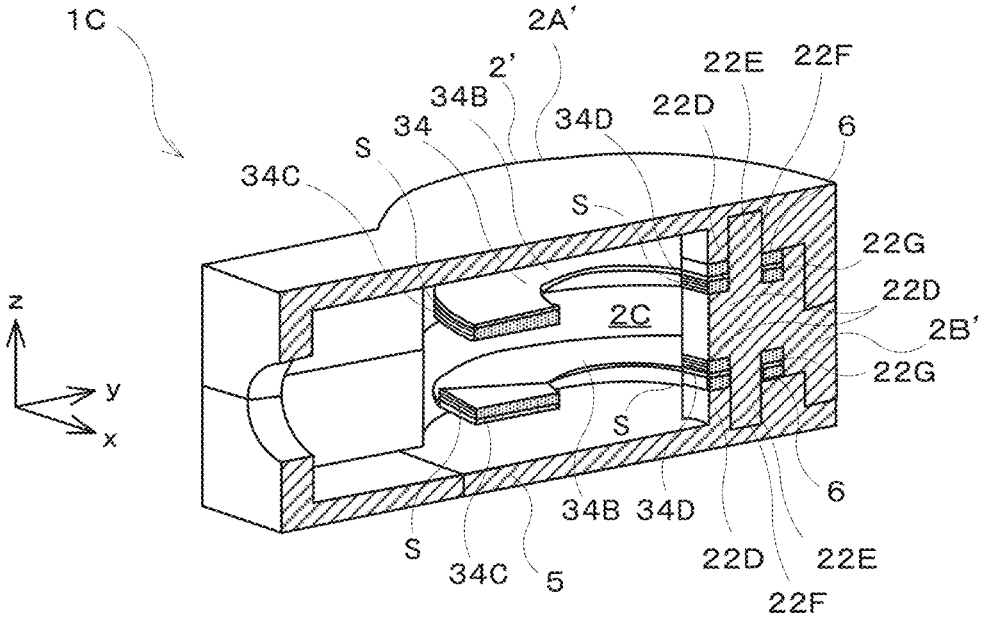
FIG. 16A is a partial cross-sectional view of a bone conduction earphone equipped with a plurality of oscillators.
Figure 16B:
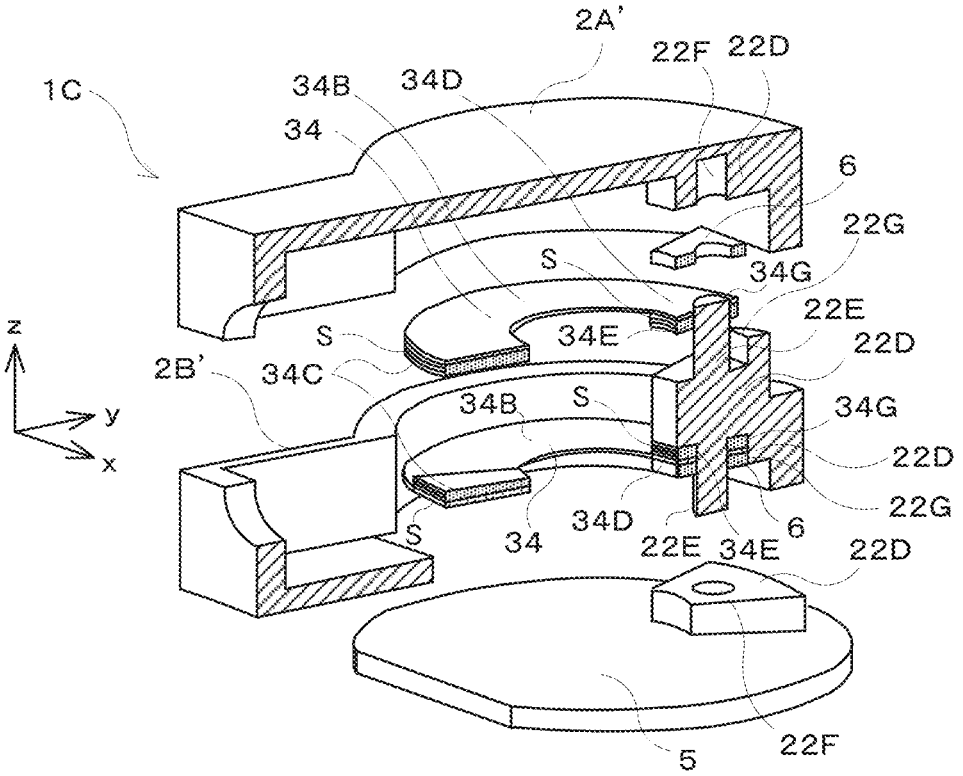
FIG. 16B is an exploded view of the bone conduction earphone illustrated in FIG. 16A.

Alternatively, two oscillators 34 having the same shape may be installed in a casing 2', as illustrated in FIGS. 16A and 16B. In a bone conduction earphone 1C having this configuration, the casing 2' includes covers 2A', 2B', and 5. The two oscillators 34 are disposed in the internal space 2C such that the main surfaces 34A are parallel to the xy plane and are spaced from each other in the z-axis direction.

The +z-side oscillator 34 is held between a fixing section 22D of the cover 2A' and a +z-side fixing section 22D of the cover 2B' with a spacer 6, while the −z-side oscillator 34 is held between a −z-side fixing section 22D of the cover 2B' and a fixing section 22D of the cover 5 with another spacer 6.

The +z-side fixing section 22D of the cover 2B' has a cylindrical boss 22E extending in the +z direction, while the z-side fixing section 22D has a cylindrical boss 22E extending in the z direction. The boss 22E extending in the +z direction is inserted into the through hole 34E of the fixed section 34D of the +z-side oscillator 34, a through hole of the spacer 6, and a recess 22F of the cover 2A'. The boss 22E extending in the −z direction is inserted into the through hole 34E of the fixed section 34D of the −z-side oscillator 34, a through hole of the spacer 6, and a recess 22F of the cover 5.

The cut-out edge 34G of the +z-side oscillator 34 abuts a +z-side side wall 22G of the cover 2B'. The cut-out edge 34G of the −z-side oscillator 34 abuts a −z-side side wall 22G of the cover 2B'. That is, each of the oscillators 34 is fixed inside the casing 2', as in the above-described Embodiment 2.

The oscillators 34 receive the same audio voltage signal and oscillate in the same phase. In comparison to the configuration equipped with a single oscillator 34, the configuration equipped with the two oscillators 34 can increase the energy of oscillations transmitted to the casing 2' to increase the electromechanical coupling coefficient, thereby further increasing the oscillatory displacement of the casing 2'.

The number of oscillators 34 is two in FIG. 16A but may be three or more. Alternatively, the bone conduction earphone 1C may be equipped with a plurality of oscillators 4, 14, and 24 having the same shape, instead of the oscillators 34.

Figure 17A:
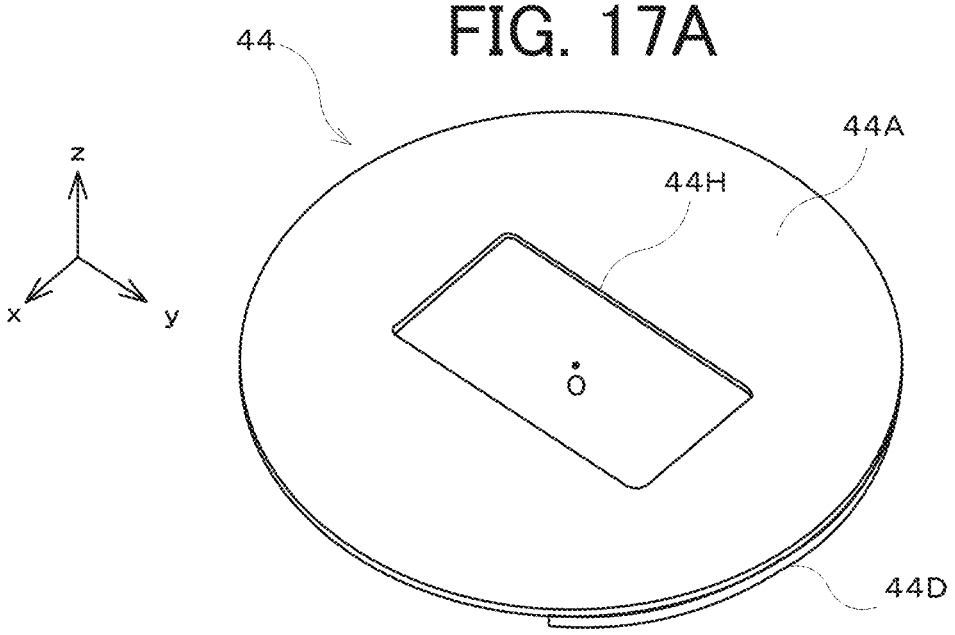
FIG. 17A illustrates an oscillator that has an opening having another shape according to a modification (upper surface)
Figure 17B:
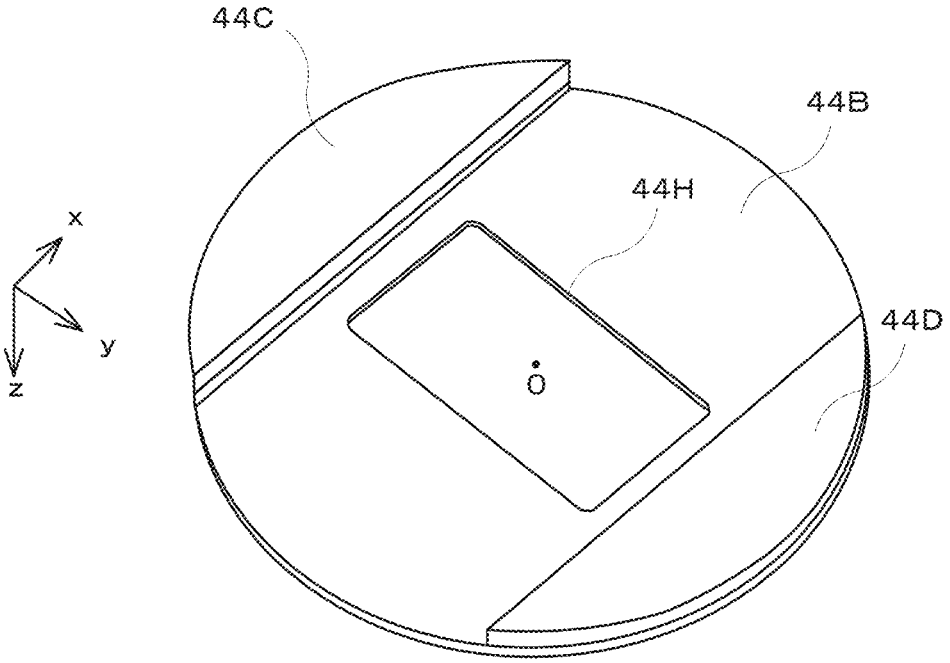
FIG. 17B illustrates the oscillator that has the opening having the other shape according to the modification (lower surface)

An oscillator 44 illustrated in FIGS. 17A and 17B may also be applied to the present embodiment. The oscillator 44 has an opening, that is, a through hole 44H having a rectangular shape. This rectangular shape has long sides extending in the direction (y-axis direction) from a fixed section 44D (fixing sections 2D) to the center O of the oscillator 44. Because of the rectangular shape of the through hole 44H, an oscillating section 44B has a further elongated-thin shape. This elongated-thin oscillating section 44B enables an increase in the oscillatory displacement of the oscillator 44, thereby increasing the sound volume. Width of the oscillating section 44B (conversely, the width of the through hole 44H) is adjusted to an appropriate width to suppress an excessive reduction in the resonant frequency.

As illustrated in FIG. 17B, the oscillator 44 is provided with a weight 44C composed of a metal, such as iron, having a specific gravity higher than silicon. This configuration can make the weight 44C much heavier, thereby further increasing the resonant frequency and oscillatory displacement of the oscillator 44.

Figure 18A:
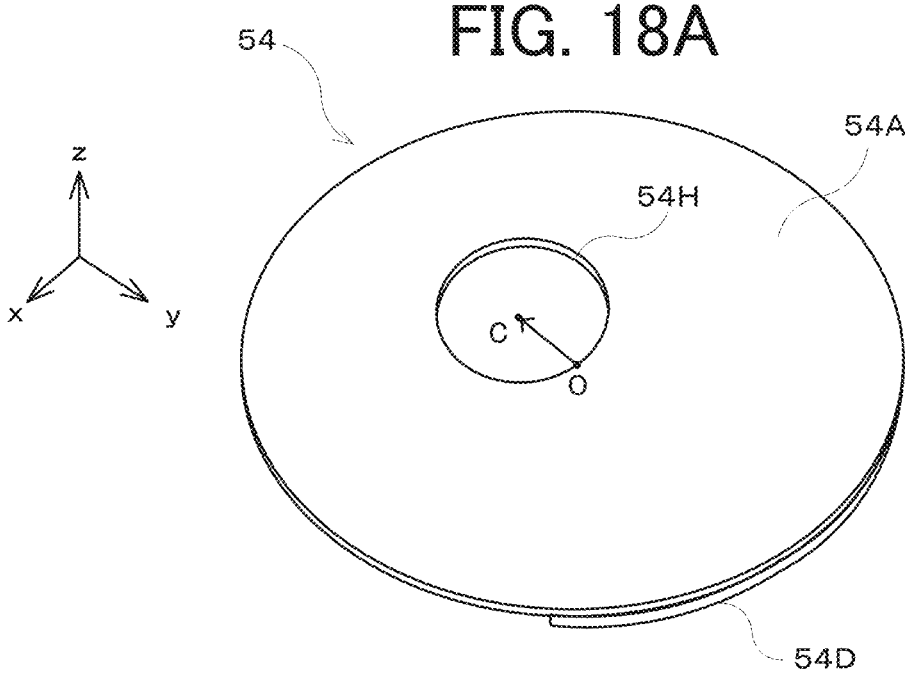
FIG. 18A illustrates an oscillator that has an opening having another shape according to a modification (upper surface)
Figure 18B:
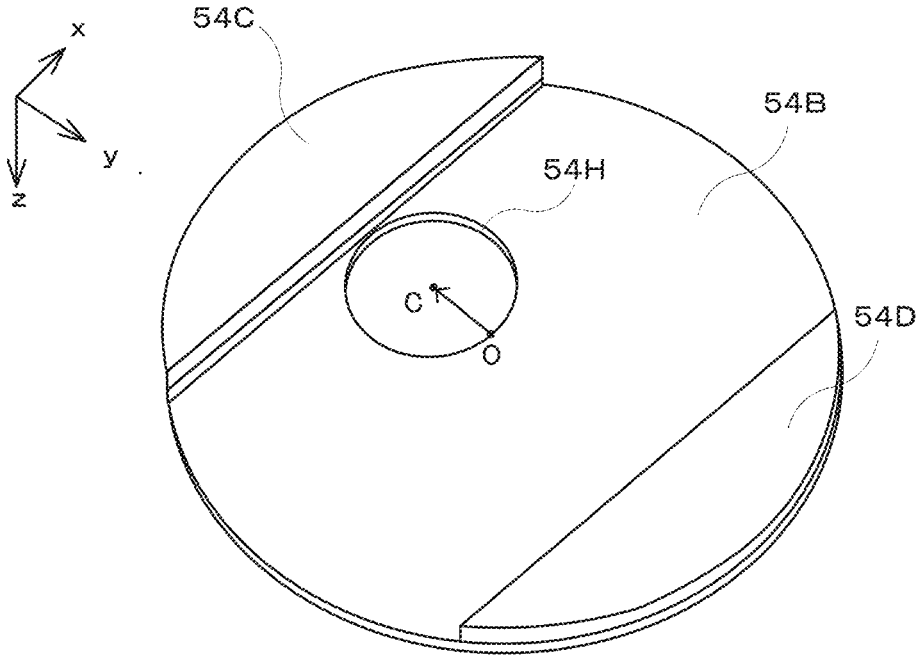
FIG. 18B illustrates the oscillator that has the opening having the other shape according to the modification (lower surface)

Alternatively, with reference to FIGS. 18A and 18B, an oscillator 54 may have an eccentric through hole 54H decentered from the center O of a main surface 54A toward the end opposite to a fixed section 54D (fixing sections 2D) (that is, displaced in the direction from the center O to the point C). That is, the width of an oscillating section 54B gradually decreases with respect to the direction from the center of the oscillator 54 to a weight 54C. This configuration can increase the oscillatory displacement of the oscillator 54, thereby further increasing the sound volume.

Embodiment 3

Embodiment 3 of the present disclosure is described below.

Figure 19:
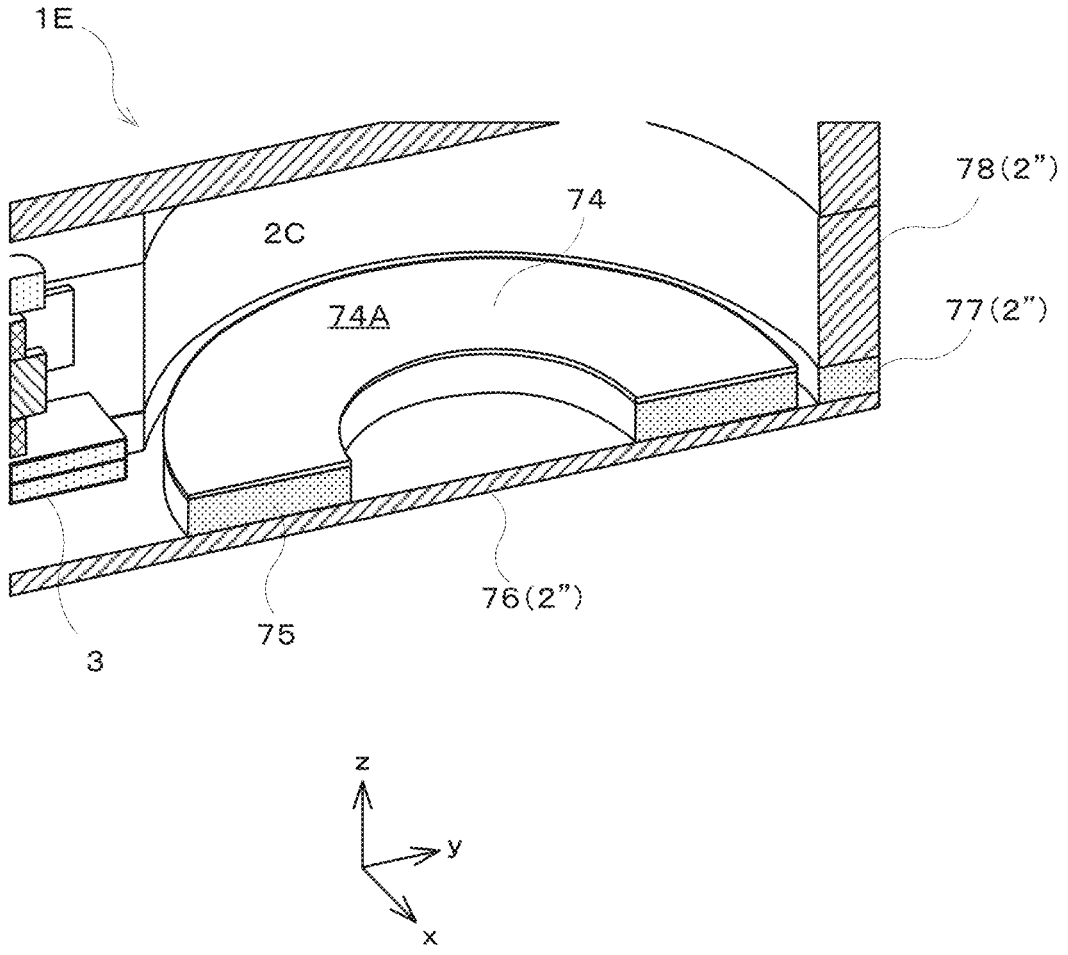
FIG. 19 is a cross-sectional view of a bone conduction earphone according to Embodiment 3 of the present disclosure.

In the bone conduction earphones 1A, 1B, and 1C according to the above-described embodiments, each of the oscillators (for example, the oscillator 4) is fixed at a single site. In contrast, in a bone conduction earphone 1E according to the present embodiment, an entire main surface 74A of an oscillator 74 is fixed to a casing bottom 76 with a double-sided tape 75, as illustrated in FIG. 19.

In more detail, the bone conduction earphone 1E includes the oscillator 74, a casing 2" (the casing bottom 76, a rubber frame 77, and a casing lateral wall 78), and the signal input unit 3. The oscillator 74 has the same structure as the above-described oscillators. That is, the oscillator 74 has a substrate and a piezoelectric layer layered on the substrate, and is a flat plate that warps and oscillates due to expansion and contraction of the piezoelectric layer.

The casing 2" has therein an internal space 2C for accommodating the oscillator 74 and can transmit the oscillations from the oscillator 74 to the outside. The signal input unit 3 receives the voltage signal input from an external device and applies the voltage signal to the piezoelectric layer of the oscillator 74. This operation causes the oscillator 74 to oscillate.

More specifically, since the entire main surface 74A of the oscillator 74 is fixed to the casing bottom 76 with the double-sided tape 75, the oscillations of the whole oscillator 74 can be transmitted directly to the casing bottom 76. As a result, most of the oscillation energy generated in the oscillator 74 is transmitted to the casing bottom 76, thereby increasing the volume of sound output from the casing bottom 76. Furthermore, the rubber frame 77 is disposed between the casing bottom 76 and the casing lateral wall 78 in the casing 2" and suppresses transmission of oscillations to the casing lateral wall 78. This structure can improve the efficiency of oscillation transmission from the casing bottom 76 to the human body.

Although the oscillator 74 is fixed to the casing bottom 76 with the double-sided tape 75 in the present embodiment, this configuration is not limiting. The oscillator 74 may also be fixed to the casing bottom 76 with an adhesive, for example.

Embodiment 4

Embodiment 4 of the present disclosure is described below.

The bone conduction earphones 1A, 1B, 1C, and 1E according to the above-described embodiments are used after the audio input terminal 3A of the signal input unit 3 is inserted directly into the earphone jack 101 of the smartphone 100. In contrast, with reference to FIG. 20, a bone conduction earphone 1D according to the present embodiment can be used separately from the smartphone 100 using a cable, without direct insertion into the earphone jack 101 of the smartphone 100.

Figure 20:
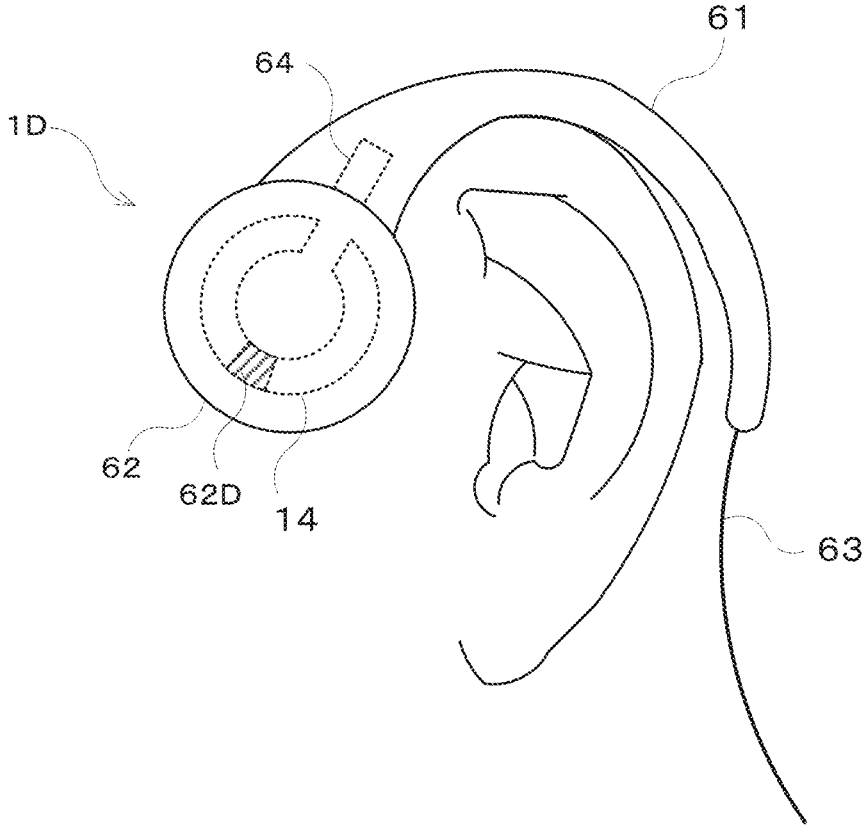
FIG. 20 illustrates a state of a phone call using a smartphone equipped with a bone conduction earphone according to Embodiment 4 of the present disclosure.

The bone conduction earphone 1D according to the present embodiment is worn on an ear, as illustrated in FIG. 20. The bone conduction earphone 1D includes a hook 61, a casing 62, a cord cable 63, and a signal input unit 64.

The hook 61 is hung on an ear of a user such that the bone conduction earphone 1D is fixed while abutting the cranial bone via the skin of the head of the user. The casing 62 accommodates the oscillator 14 in the internal space. The oscillator 14 is fixed to the casing 62 with a fixing section 62D. The cord cable 63 has an audio input terminal (earphone plug) at the end. The audio input terminal is connected to the earphone jack 101 of the smartphone 100 (refer to FIG. 1).

The audio voltage signal output from the earphone jack 101 of the smartphone 100 is input into the signal input unit 64 via the cord cable 63. The signal input unit 64 applies this audio voltage signal to the oscillator 14 accommodated in the casing 62. The oscillator 14 thus oscillates. The oscillations of the oscillator 14 are transmitted to the casing 62, thereby causing oscillations of the casing 62. These oscillations are transmitted to the user as acoustic oscillations.

Although the bone conduction earphone 1D according to the present embodiment is equipped with the oscillator 14, the present disclosure is not limited to this configuration. For example, the oscillator of the bone conduction earphone 1D may be replaced with any of the oscillators 4, 24, and 34. Alternatively, the bone conduction earphone 1D may be equipped with a plurality of these oscillators.

The bone conduction earphone 1D according to the present embodiment can be worn on the ear at all times. The user thus can start talking immediately upon receiving a call.

In the above-described embodiments, the oscillator is fixed to the casing by being held between components, by engagement using the protrusion and recess, and by abutting of the cut-out edge (with an abutting part). The present disclosure is not limited to this configuration. For example, the boss 2E may be replaced with a boss having a polygonal shape to restrict rotation of the oscillator. Alternatively, two bosses may be arranged adjacent to each other to restrict rotation of the oscillator. The cut-out edge (or an abutting part) does not necessarily have a straight profile. For example, the cut-out edge may have notches like those used in alignment of a wafer.

In any case, the oscillator is only required to have a width at least slightly longer than the width of the fixing sections. For example, the oscillator may also have a battledore-like shape.

The oscillator 34 according to the above-described embodiment has a single fixed section 34D fixed by the fixing sections 2D, as illustrated in FIGS. 15A and 15B, although the present disclosure is not limited to this configuration. The oscillator 34 may also have a plurality of fixed sections 34D, for example, two fixed sections 34D. In this case, the fixed sections 34D are arranged in a straight line passing through the center of the oscillator 34, for example. In order to fix each of these fixed sections 34D, each of the covers 2A and 2B has a plurality of fixing sections 2D, for example, two fixing sections 2D. This configuration can also be applied to the oscillators 4, 14, and 24, and the covers 2A' and 2B'.

Although the oscillators 4, 14, 24, and 34 are fabricated by MEMS technology (semiconductor manufacturing technology) in the above-described embodiments, the present disclosure is not limited to such fabrication. The oscillators 4, 14, 24, and 34 may also be fabricated by the process explained below. For example, the piezoelectric material sublayer 4D is made of a piezoelectric ceramic. The piezoelectric ceramic sublayer 4D is provided with the upper electrode sublayer 4E on a main surface in one direction and is provided with the lower electrode sublayer 4C on a main surface in the other direction, thereby yielding the piezoelectric layer 40. The lower electrode sublayer 4C of the piezoelectric layer 40 is further provided with the base material layer 4B composed of silicon. The oscillators 4, 14, 24, and 34 may be fabricated by this process.

The bone conduction earphones 1A, 1B, 1C, 1D, and 1E according to the above-described embodiments may also be used as a decorative accessory for the smartphone 100 and other devices. For example, the casings 2, 2', and 62 may have a shape representing a specific character to improve the decorative properties.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2016-117954, filed on Jun. 14, 2016, the entire disclosure of which is incorporated by reference herein.

INDUSTRIAL APPLICABILITY

The disclosure can be applied to bone conduction devices, such as bone conduction earphones. For example, the present disclosure can be applied to bone conduction cellular phones, in addition to the earphones.

REFERENCE SIGNS LIST 1A, 1B, 1C, 1D, 1E Bone conduction earphone
2, 2', 2" Casing
2A, 2B, 2A', 2B' Cover
2C Internal space
2D Fixing section
2E Boss
2F Recess
2G Side wall
3 Signal input unit
3A Audio input terminal
3B Engaging section
3C Output electrode
4, 4', 4" Oscillator
4A Main surface
4B Base material layer
4C Lower electrode sublayer
4D Piezoelectric material sublayer
4E Upper electrode sublayer
4F Fixed section
5 Cover
6 Spacer
14 Oscillator
14A Main surface
14B Arm section
14C Weight
14D Fixed section
14E Through hole
14G Cut-out edge
22D Fixing section
22E Boss
22F Recess
22G Side wall
24 Oscillator
24A Main surface
24B Arm section
24C Weight
24D Fixed section
24E Through hole
24G Cut-out edge
34 Oscillator
34A Main surface
34B Oscillating section

34C Weight
34D Fixed section
34E Through hole
34G Cut-out edge
40 Piezoelectric layer
41 Support substrate layer
44 Oscillator
44A Main surface
44B Oscillating section
44C Weight
44D Fixed section
44H Through hole
54 Oscillator
54A Main surface
54B Oscillating section
54C Weight
54D Fixed section
54H Through hole
61 Hook
62 Casing
62D Fixing section
63 Cord cable
64 Signal input unit
74 Oscillator
74A Main surface
75 Double-sided tape
76 Casing bottom
77 Rubber frame
78 Casing lateral wall
100 Smartphone
101 Earphone jack
h User
S Scallop

The invention claimed is:

1. A bone conduction device comprising:

an oscillator that is a multilayer flat plate, including a substrate and a piezoelectric layer layered on the substrate, for warping to oscillate in a direction orthogonal to a main surface of the oscillator due to expansion and contraction of the piezoelectric layer;

a casing having an internal space accommodating the oscillator and a fixing section fixing a circumferential edge of the oscillator, the casing being conductive of oscillations to the outside via the fixing section; and a signal input unit for receiving a voltage signal input from an external device and applying the voltage signal to the piezoelectric layer, wherein the oscillator has a main surface having an entire width longer than an entire width of the fixing section in a direction orthogonal to a direction extending from the fixing section to a center of the oscillator, and the main surface of the oscillator has an opening extending in a direction of oscillations for adjustment of a resonance frequency of the oscillator.

2. The bone conduction device according to claim 1, wherein the fixing section fixes the circumferential edge of the oscillator at a single site.

3. The bone conduction device according to claim 1, wherein the opening of the oscillator has a rectangular shape having long sides extending in the direction from the fixing section to a center of the oscillator.

4. The bone conduction device according to claim 1, wherein the opening of the oscillator is decentered from a center of the main surface toward an end opposite to the fixing section.

5. The bone conduction device according to claim 1, wherein the oscillator has a cut-out portion that faces the signal input unit.

6. The bone conduction device according to claim 5, wherein the oscillator has a C-shape, a U-shape, or a concave shape.

7. The bone conduction device according to claim 1, wherein the fixing section is disposed at an end opposite to the signal input unit.

8. The bone conduction device according to claim 7, wherein the main surface of the oscillator is symmetrical about a line that extends from a center of the fixing section through the center of the oscillator.

9. The bone conduction device according to claim 1, wherein the fixing section fixes the oscillator by sandwiching the oscillator.

10. The bone conduction device according to claim 9, wherein the fixing section has a protrusion protruding in a direction intersecting the main surface of the oscillator, and the oscillator has a through hole into which the protrusion is inserted.

11. The bone conduction device according to claim 9, wherein the oscillator has a straight cut-out edge having a straight profile and fixed by the fixing section, and the fixing section has a contact wall to come into contact with the straight cut-out edge.

12. The bone conduction device according to claim 9, wherein the oscillator has a fixed section held and fixed by the fixing section, and scallops are formed on a side wall of the fixed section, the scallops being irregularities repeated in a thickness direction of the fixed section.

13. The bone conduction device according to claim 1, wherein the oscillator further includes a weight at a free end of the oscillator.

14. The bone conduction device according to claim 1, wherein scallops are formed on a side wall of the weight, the scallops being irregularities repeated in a thickness direction of the weight.

15. The bone conduction device according to claim 1, further comprising a hook for fixing the casing so as to abut the cranial bone of the user when the hook is hung on an ear of the user.

16. The bone conduction device according to claim 1, wherein the oscillator is a plurality of oscillators.

17. The bone conduction device according to claim 1, wherein an additional layer is formed on one of the main surface and an opposite surface of the oscillator, and the additional layer has a rate of expansion and contraction different from that of the piezoelectric layer.

18. The bone conduction device according to claim 17, wherein the additional layer is a silicon layer.

* * * * *